US009527631B2

(12) United States Patent
Grittmann et al.

(10) Patent No.: US 9,527,631 B2
(45) Date of Patent: Dec. 27, 2016

(54) STOPPER FOR A BEVERAGE CONTAINER

(71) Applicant: Fass-Frisch GmbH, Eppingen-Mühlbach (DE)

(72) Inventors: Dennis Grittmann, Eppingen (DE); Michael Diefenbacher, Sulzfeld (DE); Gerd Krüger, Eppingen (DE)

(73) Assignee: Fass-Frisch GmbH, Eppingen-Mühlbach (DE)

( * ) Notice: Subject to any disclaimer, the term of this patent is extended or adjusted under 35 U.S.C. 154(b) by 0 days.

(21) Appl. No.: 14/395,067

(22) PCT Filed: Apr. 11, 2013

(86) PCT No.: PCT/IB2013/000661
§ 371 (c)(1),
(2) Date: Oct. 17, 2014

(87) PCT Pub. No.: WO2013/156833
PCT Pub. Date: Oct. 24, 2013

(65) Prior Publication Data

US 2015/0108080 A1 Apr. 23, 2015

(30) Foreign Application Priority Data

Apr. 18, 2012 (DE) ..... 10 2012 007 642

(51) Int. Cl.
*B67D 7/78* (2010.01)
*B65D 39/12* (2006.01)
*B65D 45/32* (2006.01)

(52) U.S. Cl.
CPC ..... *B65D 39/12* (2013.01); *B65D 45/32* (2013.01); *B65D 45/327* (2013.01)

(58) Field of Classification Search
CPC ..... B65D 39/12; B65D 75/32; B65D 21/002; B65D 83/28; B67D 1/0829; B67D 1/0831; B67D 1/0801; B67D 1/0418; B67D 2210/00028
(Continued)

(56) References Cited

U.S. PATENT DOCUMENTS 232,653 A * 9/1880 Shaw ..... B67D 1/0829 217/111
1,966,384 A * 7/1934 Gabel ..... B67D 3/04 217/111
(Continued)

FOREIGN PATENT DOCUMENTS

DE 1 233 321 1/1967
DE 1815006 7/1970
(Continued)

*Primary Examiner* — Kevin P Shaver
*Assistant Examiner* — Michael J Melaragno
(74) *Attorney, Agent, or Firm* — Gudrun E. Huckett

(57) ABSTRACT

The invention relates to a stopper (1) for a beverage container, a tapping assembly and a beverage container (100). The stopper (1) comprises an outer part (4) which has a ring flange (41) and a sleeve (42), the sleeve (42), below the ring flange (41), being circumferentially deformed to form a bulge (43), and a spreading ring (3) which has a ring flange (31) and a plurality of L-shaped elements (32) which have a pivot (D) at the angle of the "L" and the free ends of which are designed as hooks (33), and a bushing (2) and a rotational cover (5), which has a cover plate (54) and a sleeve (51). When the stopper (1) is in a position of nonuse, the spreading ring (3) is pre-positioned in the outer part (4), the bushing (2) protrudes partially into the spreading ring (3), and the hooks (33) point radially inward. The rotational cover (5) can provide a closure arrangement, in which the rotational cover (5), the spreading ring (3), and the bushing (2) are accommodated so far from the outer part (4) that the
(Continued)

hooks (33) of the spreading ring (3) are turned outward and engage in the bulge (43), whereby a circumferential projection is pressed in the direction of an underside of the ring flange (41).

17 Claims, 8 Drawing Sheets

(58) Field of Classification Search
USPC ..... 222/464.1, 542, 541.1, 400.7; 137/318; 220/791
See application file for complete search history.

(56) References Cited

U.S. PATENT DOCUMENTS 2,048,031 A * 7/1936 Rice ..... B65D 39/082 217/113
2,081,131 A * 5/1937 Barnes ..... B67D 1/0829 217/110
2,107,165 A * 2/1938 Rice ..... B67D 3/04 222/400.7
2,646,293 A * 7/1953 Gray ..... B65D 39/082 174/153 G
2,889,089 A * 6/1959 Herrick ..... F16L 37/008 222/540
2,897,533 A * 8/1959 Bull ..... F16J 15/025 16/2.1
2,907,489 A * 10/1959 Taylor, III ..... B65D 47/148 220/258.3
2,969,161 A * 1/1961 McCulloch ..... B65D 39/082 215/253
3,141,586 A * 7/1964 Wetterek ..... B65D 39/08 215/262
3,240,392 A * 3/1966 Nicko ..... B67D 1/0829 222/82
3,343,699 A * 9/1967 Nicko ..... B67D 1/0829 215/247
3,348,734 A * 10/1967 Rice ..... B67D 1/0802 222/1
3,545,475 A * 12/1970 Johnson, Jr. ..... B67D 1/0802 137/212
3,828,962 A * 8/1974 Atkins ..... B65D 41/17 215/295
3,945,529 A * 3/1976 Haag ..... B65D 51/20 220/254.1
4,041,241 A * 8/1977 Olmstead ..... H01B 17/308 174/153 G
4,177,828 A * 12/1979 Vache ..... F17C 7/00 137/318
4,319,757 A * 3/1982 Fitzpatrick-Ellis ..... F16J 15/36 277/383
4,363,336 A * 12/1982 Cerrato ..... B67D 1/0832 137/212
4,572,390 A * 2/1986 Grittmann ..... B65D 39/08 215/364
4,854,486 A * 8/1989 Daley ..... B67D 3/02 137/588
4,995,521 A * 2/1991 von Schuckmann B65D 51/002 215/247
5,094,365 A * 3/1992 Dorfman ..... B67D 1/0829 137/212
5,353,472 A * 10/1994 Benda ..... B62D 25/24 16/2.2
5,433,330 A * 7/1995 Yatsko ..... A61J 1/1406 215/247
5,499,737 A * 3/1996 Kraus ..... F16B 37/043 138/89
5,584,513 A * 12/1996 Sweeny ..... F16L 37/0925 285/243
5,732,440 A * 3/1998 Wright ..... H02G 3/083 16/2.2
5,893,480 A * 4/1999 Dore ..... B62D 25/24 215/355
6,017,331 A * 1/2000 Watts ..... A61M 5/24 604/201
6,161,716 A * 12/2000 Oberhofer ..... B65D 51/1683 215/311
6,554,019 B1 * 4/2003 Grittmann ..... B65D 51/1683 137/318
6,845,887 B1 * 1/2005 Granger ..... B65D 47/043 222/153.06
7,090,257 B2 * 8/2006 Werth ..... F16L 33/225 285/243
7,604,147 B2 * 10/2009 Anderson ..... B67D 1/0462 222/105
7,922,212 B2 * 4/2011 Werth ..... A61M 39/12 285/242
7,922,213 B2 * 4/2011 Werth ..... F16L 33/2071 285/242
8,690,161 B2 * 4/2014 Cayzac ..... B60R 16/0222 174/650
2008/0116165 A1 * 5/2008 Lin ..... B65D 39/12 215/294
2008/0203118 A1 * 8/2008 Sauer ..... B67D 1/0418 222/396
2009/0320264 A1 * 12/2009 Berger ..... B67D 1/0835 29/428
2010/0224632 A1 * 9/2010 Aneas ..... B65D 51/002 220/315
2011/0210141 A1 * 9/2011 Maas ..... B08B 9/0321 222/1
2011/0280502 A1 * 11/2011 Meike ..... B67D 1/0829 383/42
2011/0284589 A1 * 11/2011 Serrano ..... B65D 47/0885 222/556
2012/0187072 A1 * 7/2012 Belle ..... B65D 51/002 215/274
2013/0334253 A1 * 12/2013 Ahlstrom ..... B67D 1/0845 222/153.01

FOREIGN PATENT DOCUMENTS

DE 100 05 879 A1 6/2001
DE 21 2005 000 063 U1 8/2007
DE 20 2007 001 028 U1 7/2008
DE 10 2007 029 450 A1 1/2009
GB 775 309 5/1957

* cited by examiner

STOPPER FOR A BEVERAGE CONTAINER

BACKGROUND OF THE INVENTION

The following invention concerns a stopper for a beverage container such as in particular for a beer keg, a tapping assembly comprising the stopper, and the beverage container itself that is closed off by the stopper.

It is known to provide beverage containers such as beer kegs, including also the so-called party kegs having a fill volume of usually 5 or 10 liters, with a fill or outlet opening that, during storage of the beverage container, is tightly closed off and is then provided with a tapping assembly when the beverage container or the keg is to be used. These outlet openings are provided with a closure that usually is removed and exchanged for a dispensing device such as an outlet socket or a tap when the beverage is to be consumed. Alternatively, closures are known also which constitute at the same time a stopper as well as a tap.

Such a closure is disclosed, for example, in DE 21 2005 000 063 U1. Here, a closure in the form of a tap or stopper for a beverage container such as a beer keg is disclosed whose main task is to avoid the disadvantageous effect of oxygen entering the interior of the container. This is achieved in that the tap has at least one injection-molded plastic part that is doped with a scavenger. Herein, the tap can be comprised of at least two parts that are movable relative to each other by means of which a dispensing opening can be closed off, wherein at least one of the parts is the scavenger-doped plastic part.

While this closure has the task of keeping oxygen away from the beverage in the container, the stopper that is disclosed in DE 10 2007 0 29 450 A1 has the function of an overpressure safety means. Here, reference is also being had to party kegs that are constructed as three-part seamed closure kegs, comprising a body with a welded longitudinal seam and bottom and top that are connected to the body by a seam. Against a pressure increase by $CO_2$ development past a certain limit value, an overpressure safety means is to be provided by means of which, in case of an unexpected pressure increase, pressure can escape from the container to the exterior before overloading of the seamed connection or bursting of the container can occur. Accordingly, a stopper that is insertable into an opening of the container in a seal-tight way is disclosed herein which has a passage that is closed seal-tightly by a film that forms a seal that yields and opens the passage opening when a certain pressure is surpassed.

SUMMARY OF THE INVENTION

In principle, there is however the further task of protecting the rim of the fill opening from corrosion when such stoppers are inserted into a fill opening because such beverage containers, such as especially the aforementioned party kegs, are usually made of sheet metal—as disclosed above—and begin to corrode upon contact with the beverage. This is disadvantageous with respect to taste, on the one hand, and impairs the safe seat of the closure in the opening, on the other hand.

Based on this prior art, the present invention has the object of providing an improved stopper which can avoid corrosion at the rim of a fill opening of corrosive material.

This object is solved by a stopper for a beverage container, comprising:

an outer part that has an annular flange which passes into a sleeve which, below the annular flange, is deformed circumferentially to a bulge, a spreading ring that comprises an annular flange from which a plurality of L-shaped elements that are spaced apart from each other extend in downward direction and comprise a pivot point at the angle of the "L" and whose free ends are configured as hooks, a bushing, a rotary cover that comprises a cover plate from which, displaced radially inwardly, a sleeve extends in downward direction, wherein in an arrangement of non-use of the stopper the spreading ring is pre-positioned in the outer part, the bushing projects partially into the spreading ring, the rotary cover is pre-positioned in the bushing, and the hooks point inwardly in radial direction, and wherein by means of the rotary cover a closure arrangement can be provided in which the rotary cover, the spreading ring, and the bushing are accommodated so far within the outer part that the hooks of the spreading ring are present in outwardly rotated position and engage the bulge so that a circumferential projection formed by the bulge is present in a position forced in the direction toward an underside of the annular flange.

A further object is providing an improved tapping assembly that also is embodied more safely with regard to corrosion at the fill opening rim of a beverage container.

This object is solved by the tapping assembly comprising a stopper of the present invention as explained above and a tapping device comprising a draw tube, wherein the draw tube extends through the stopper.

A further object of providing a corrosion-protected beverage container, in particular a beer keg such as a party keg, is solved by the beverage container comprising a fill opening that has a rim, wherein the fill opening is closed by a stopper, wherein the rim is fluid-tightly surrounded by the circumferential projection formed by the bulge of the outer part which is present in a position forced in the direction toward the underside of the annular flange of the outer part.

A stopper according to the invention for a beverage container in a first embodiment comprises at least one outer part with an annular flange which passes into a sleeve, wherein below the annular flange the sleeve is deformed circumferentially to a bulge. Moreover, the stopper comprises a spreading ring which comprises an annular flange from which a plurality of L-shaped elements, spaced apart from each other, extend downwardly and have a pivot point at the angle of the "L" and whose free ends are formed as hooks. Moreover, a bushing and a rotary cover with a cover plate are encompassed, wherein from the latter, radially inwardly displaced, a sleeve extends downwardly. Now, in an arrangement of non-use of the stopper, in which the latter is not yet inserted into a fill opening of the beverage container, the spreading ring is pre-positioned in the outer part and the bushing projects a little into the spreading ring whose hooks are pointing radially inwardly.

By pressing in the rotary cover, without however turning it, an advantageous closure arrangement can be produced. In this way, the rotary cover, the spreading ring, and the bushing are received to such an extent in the outer part that the hooks of the spreading ring are rotated outwardly. Since the hooks have a pivot point at the angle of the "L", they are rotatable or pivotable outwardly so that therefore in the arrangement of use, which may be a closure arrangement in which the container is only closed or a tapping assembly in which the stopper is part of a tapping device, the free ends of the hooks can point outwardly. This is advantageous because in this way the hooks engage the bulge which is configured as a nose or circumferential projection at the outer side and is then forced in the direction of the underside of the annular flange and is also radially deformed, and therefore can enclose safely and clamp fluid-tightly a fill opening rim of the container introduced into the gap between nose and annular flange of the outer part. Accordingly, after locking of the stopper, the contact of filled in medium (beverage) with metal is avoided. The beverage is thus protected from rust which otherwise forms in party kegs of sheet metal.

The deformation of the nose in order to achieve its sealing purpose is realized particularly well when the outer part is made of plastic material, preferably of a thermoplastic elastomer, optionally of rubber.

In order to be able to insert the stopper easily into the fill opening of a container, the sleeve of the outer part tapers conically in downward direction in respect to its outer circumference.

Suitably, the stopper comprises a device to close it off. For this purpose, from below, i.e., in the arrangement of use from the keg side, a plug is attached that comprises a cover plate from which centrally a core extends away that is surrounded by a sleeve spaced apart by a gap. The plug can be plugged in from below onto the outer part and, when the rotary cover is removed, it can be pushed into the beverage container without a problem. It is seated seal-tightly and with form fit on the outer part.

In a further embodiment, the core and the sleeve and the gap are arranged for this purpose relative to each other such that the plug, on the side which is facing away from the annular flange of the outer part, is form-fittingly and seal-tightly attachable to the outer part.

Moreover, the core and the sleeve and the gap are arranged relative to each other such that the core also is resting with form fit in the sleeve of the rotary cover when the latter is arranged in the stopper; in this context, preferably a cross-sectional shape of the core and an inner cross-sectional shape of the sleeve are designed such that they can be brought into rotary engagement with each other.

In this context, an elongate or oval cross-sectional shape or another cross-sectional shape of the core, which corresponds appropriately with the sleeve of the rotary cover or can be brought into engagement, can be employed.

The plug can moreover comprise lateral radial venting bores. Corresponding venting bores are positioned in this embodiment in the outer part so that upon rotation of the plug by means of the rotary cover for venting purposes the otherwise displaced bores are brought into alignment with each other and may enable air inlet for the purpose of pressure compensation when tapping.

The bushing is advantageously longer than the spreading ring and has on its outer circumference a groove which in the closure arrangement surrounds an inner bottom edge of the hooks. In this way, the spreading ring can be secured and held in its position even when the rotary cover is removed.

Advantageously, the bushing for producing the groove can be beveled externally at the bottom. Also, the bushing can be beveled at its upper rim. This embodiment facilitates, for example, introduction of the draw tube. The bushing is advantageously made of a hard material such as a non-elastic plastic material so as not to be deformed when the rotary cover is released or removed.

In a suitable exemplary embodiment of the stopper, the annular flange comprises at its inner side an inner circumferential step by means of which a support surface in a first plane, positioned below the plane of the annular flange surface, and there below a support surface in a second plane result on which the flanges of the rotary cover and of the spreading ring are resting underneath each other so that a flush smooth stopper surface is provided which can be seen on the exterior of the keg.

It may be desired to remove the rotary cover when, after providing the closure arrangement, a draw tube of a tapping device is to be introduced into the remaining cylindrical opening formed by the bushing while keeping the arrangement of the spreading ring.

Therefore, in a first embodiment of a tapping assembly according to the invention, the stopper according to one embodiment of the invention and moreover a tapping device with a draw tube are encompassed which extends through the stopper and is resting at least in the bushing. Advantageously, in a further embodiment of the tapping assembly the draw tube is engaged in the outer part of the stopper by an inner circumferential bead of the outer part in a fluid-tight way.

Finally, a beverage container according to the invention, with a fill opening provided with a rim, comprises the stopper. The fill opening is closed off by it and the rim is fluid-tightly circumferentially engaged by the circumferential projection that is formed by the bulge of the outer part and is forced in the direction of the bottom side of the annular flange of the outer part so that the rim is corrosion-protected.

BRIEF DESCRIPTION OF THE DRAWINGS

These and further advantages are explained by the following description with reference to the attached figures. The reference to the figures in the description serves for supporting the description and for facilitating understanding of the subject matter. Objects or parts of objects which are substantially identical or similar may be provided with the same reference characters. The figures are only schematic illustrations of embodiments of the invention. It is shown in.

DESCRIPTION OF PREFERRED EMBODIMENTS

Figure 1:
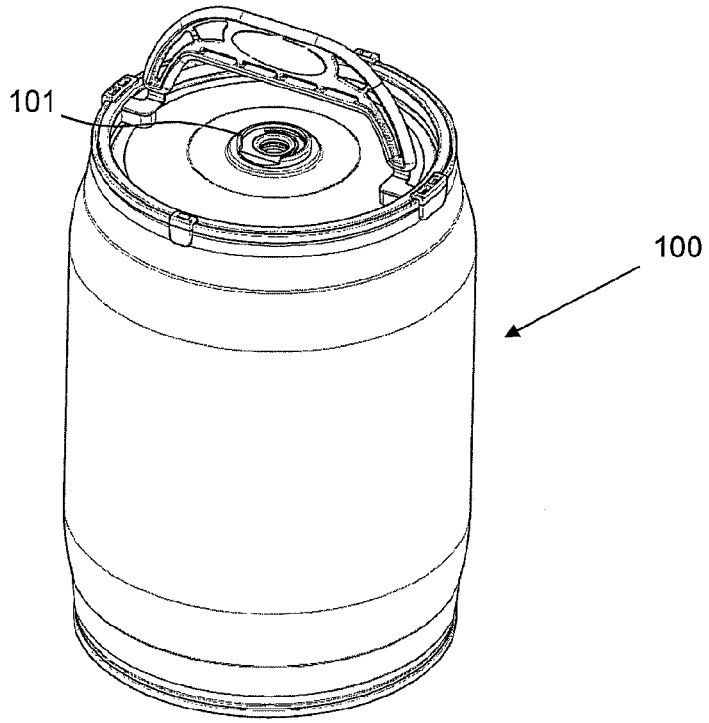
FIG. 1 a perspective view of a party keg with a fill opening that is provided at the top.

The beverage container that is illustrated in FIG. 1 is a beer keg 100 or party keg 100 with a fill volume of a few liters. It has at its top a fill opening into which the stopper 1 according to the invention can be inserted.

FIGS. 2 to 6 show in this context configurations of the stopper according to the invention. As can be seen in FIG.

3, a stopper 1 according to the invention can comprise, viewed from the exterior to the interior, first an outer part 4 which—in relation to its position in the beer keg 100 when in use—has at its topside an annular flange 41 which passes into a sleeve 42 which, with respect to its outer circumference, conically tapers in downward direction. The sleeve 42 can also be seen well in FIGS. 5 and 6. The annular flange 41 has at its inner side an inner circumferential step by means of which a support surface 41' in a first plane, which is positioned below the plane of the annular flange surface, and there below a support surface 41" in a second plane are provided.

Below the annular flange 41 the sleeve 42 is deformed circumferentially to a projection, it forms essentially a nose 43 thereat, whose shoulder 43' is pointing in the direction of the underside of the annular flange 41. Accordingly, between the shoulder 43', the nose 43, and the underside of the annular flange 41 a groove is formed that is dimensioned just about so that it engages from below the rim of a beverage container opening, such as the rim 102 about the fill opening 101 of the party keg 100 in FIG. 4. As will be explained further with the aid of FIG. 4, the nose 43 is designed such that the groove engages the rim 102 of the fill opening 101 of the party keg 100 (only shown partially) at the cut edge in such a way that the rim 102 is protected from corrosion.

In particular in case of containers of sheet metal, by introducing the fill opening 101 an unprotected and thus corrosion-prone sheet metal edge is generated which is now seal-tightly received by the stopper 1 according to the invention, respectively, the nose 43, and therefore is advantageously protected from corroding beverage contact.

This is achieved by the following configuration of the stopper 1.

Figure 3:
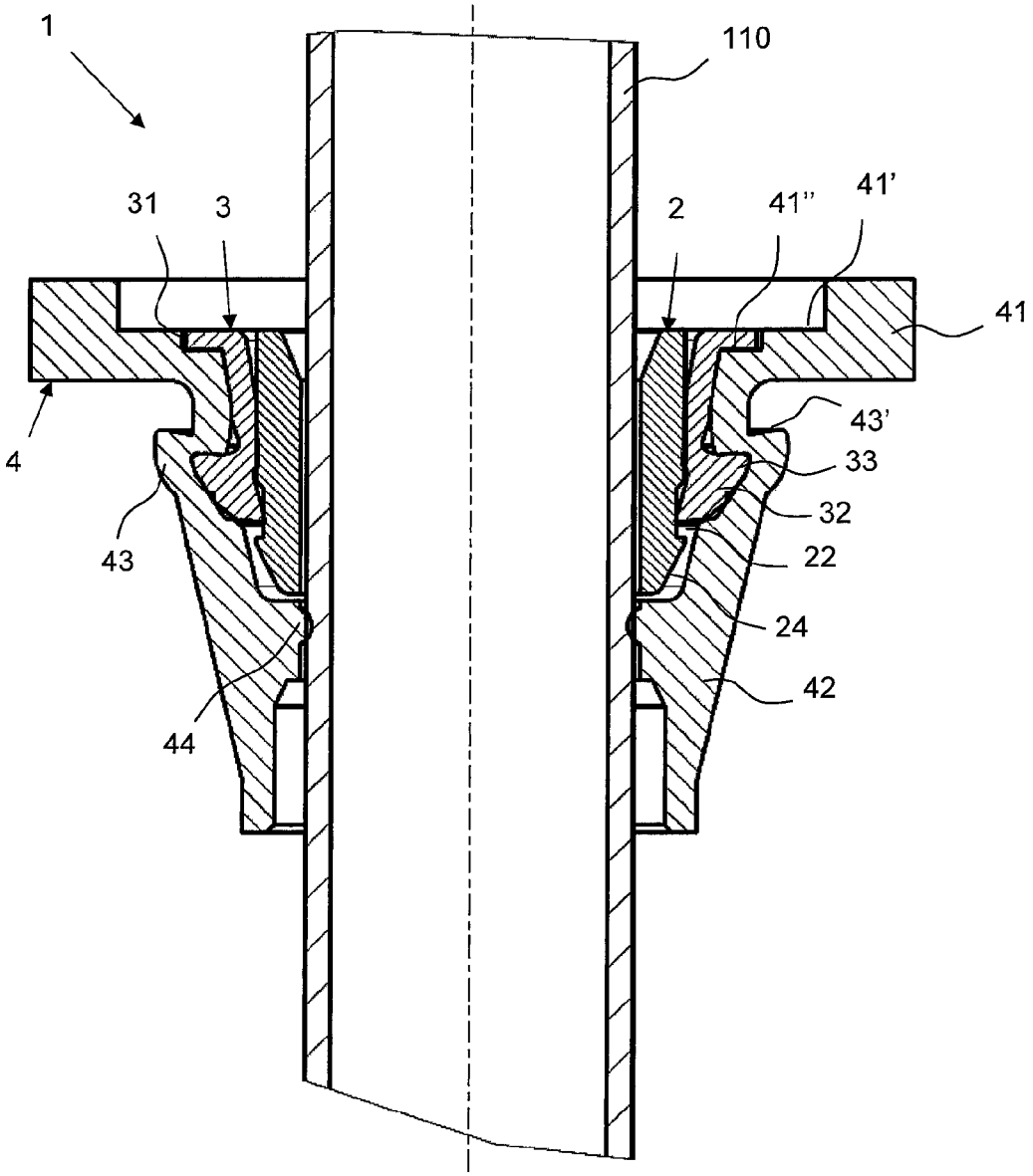
FIG. 3 a side view in section of a stopper according to the invention, with rotary cover being pulled out.

In the outer part 4, made of plastic material in order to be appropriately deformable, preferably of a thermoplastic elastomer such as rubber, the spreading ring 3 is positioned; see FIG. 3. The latter has an annular flange 31 from which a plurality of approximately L-shaped elements 32 with legs 32*a*, 32*b* extend downwardly and whose free ends (legs 32*b*) are radial inwardly pointing and comprise a first face 32*b*1 facing in axial direction upwardly and a second face 32*b*2 facing in axial direction downwardly and hooks 33 arranged on the second faces 32*b*2. The L-shaped elements 32 are somewhat spaced apart from each other and taper from the top to the bottom down to the hooks 33 in regard to width. The L-shaped elements 32 are designed such that they form a pivot point D at the angle of the "L" where the legs 32*a*, 32*b* of the "L" meet, see FIGS. 7*a* and 7*b*, and therefore the legs 32*b* with hooks 33 are rotatable or pivotable in outward direction so that, in the arrangement of use, which can be a closure arrangement or a tapping assembly, the free ends 33*a* of the hooks 33 point outwardly (see FIG. 4). Instead of the L-shape, also another suitable shape can be selected.

Figure 4:
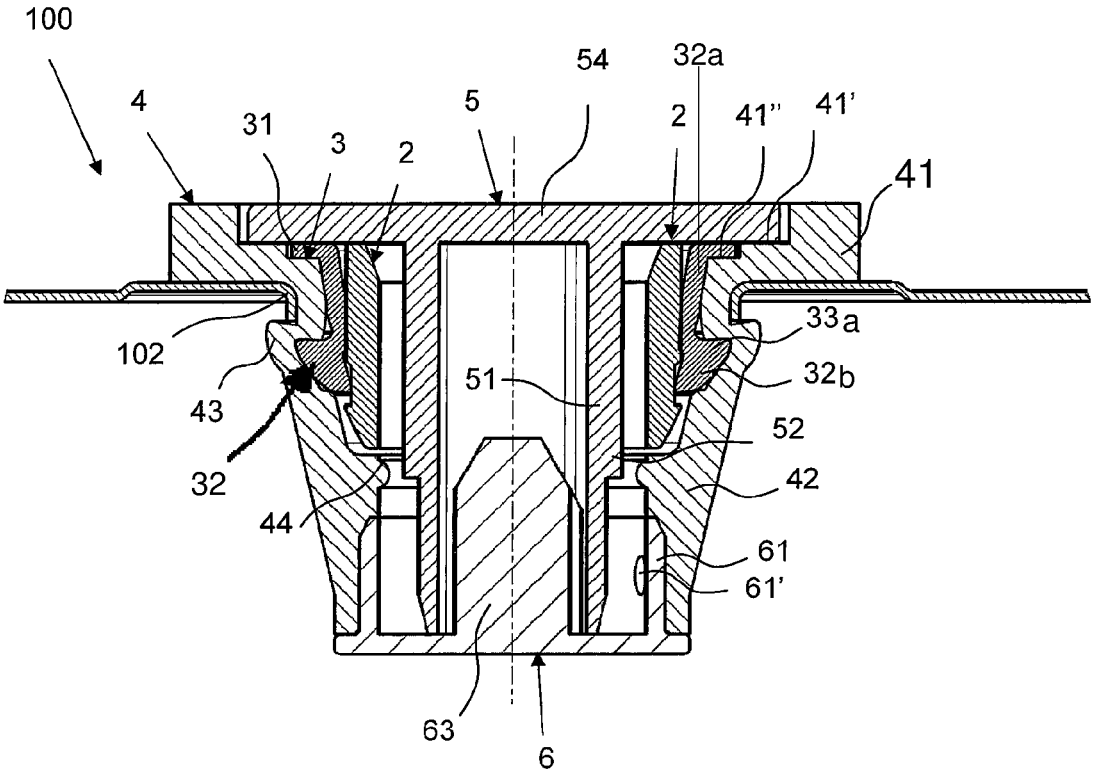
FIG. 4 a side view in section of a stopper according to the invention, with pushed-in rotary cover.
Figure 7A:
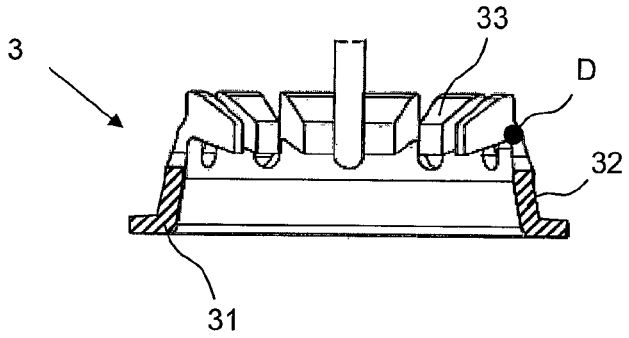
FIG. 7*a* a first perspective section view of the spreading ring.
Figure 7B:
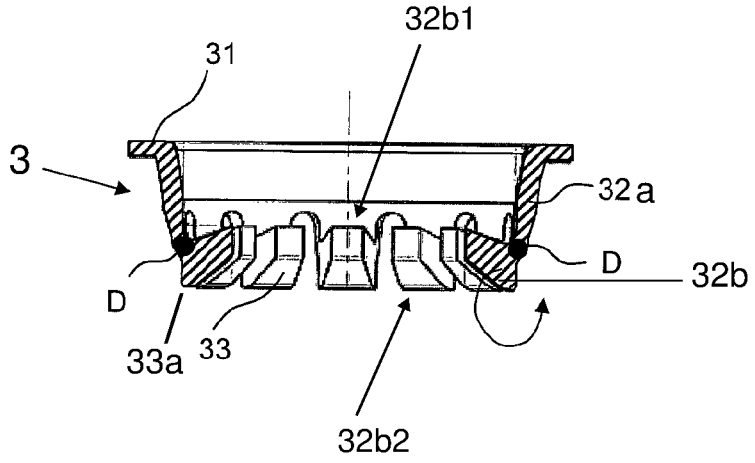
FIG. 7*b* a further perspective section view of the spreading ring.

The design of the spreading ring is apparent from FIGS. 7*a* and 7*b*. Here, the spreading ring 3 is shown in the arrangement of non-use, i.e., without performing its function in the stopper 1. The hooks 33 are pivoted outwardly only once pressure is exerted on the inner side of the spreading ring 3 and form then the outwardly pointing projections that, upon transfer into the arrangement of use (as described below), see e.g. FIG. 4, are brought into engagement with the sleeve 42 at the inner side in the area of the nose 43. Then, the hooks 33 engage from below the circumferential nose 43 and force it away in radial outward direction whereby the latter is placed as fluid-tightly as possible about the opening rim 102 of the fill opening 101 of the beer keg 100. In the area of the nose 43, the sleeve 42 is thus configured on the inner side such that on the inner circumference a "spreading cage" is formed, see also FIG. 8, which receives the spreading ring 3.

The annular flange 31 has a width that corresponds just about to the depth of the contact surface 41" in the second plane of the outer part 4 on which, in contact position of use, it is resting in such a way that the spreading ring 3 does not slide downwardly and is maintained in its desired position.

Figure 2:
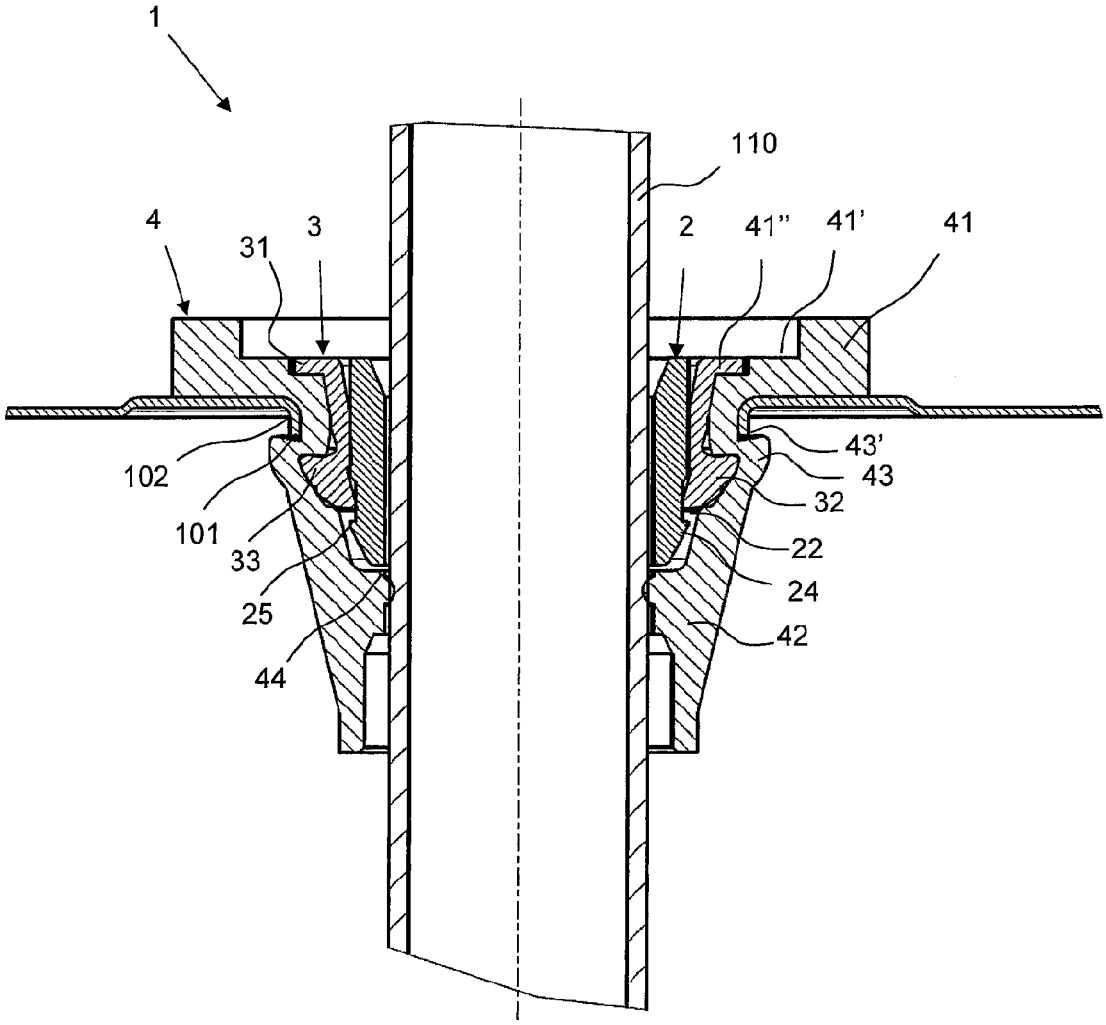
FIG. 2 a side view in section of a stopper according to the invention, inserted into a fill opening.

Moreover, within the spreading ring 3 a bushing 2 is positioned, see e.g. FIG. 2, that is made of a hard material such as a hard plastic material and that is circumferentially beveled at the bottom externally and at the top internally. The upper bevel serves for easier insertion of a draw tube, when the tapping assembly is produced.

A little above the lower bevel 24, the bushing 2 comprises a groove 22 so that groove 22 and lower bevel 24 also form a nose 25. In the arrangement of use, the bushing 2 which is longer than the spreading ring 3 can thus inwardly stabilize and secure the latter and ensure a uniform force application onto the L-shaped elements 32 upon transfer from the arrangement of non-use into the arrangement of use. Suitably, the bushing 2 is just about so much longer than the height of the spreading ring 3 that, with aligned upper rims of the two components 2, 3, the nose 25 engages from below the outwardly pivoted hooks 33.

In order to transfer the stopper 1 from its arrangement of non-use into an arrangement of use in which it securely closes off the beer keg 100, first the closure stopper 1 is inserted into the fill opening 101 (also referred to as bung hole) of the beer keg 100 wherein the soft nose 43 below the annular flange 41 generates the greatest insertion resistance and therefore the diameter of the outer part 4 about the nose 43 is only a little greater (within the mm range, approximately 0.5 to 2.2 mm, rather 0.8 to 2.0 mm) than the diameter of the fill opening 101. Accordingly, the stopper 1 can be inserted into the fill opening 101 comparatively easily and without tool. The material of the outer part 4 can have suitably a Shore hardness in the range of 55 to 90, preferably about 70, in order to be sufficiently soft for the desired deformation.

The rotary cover 5 is pre-positioned in the arrangement comprised of

- the bushing 2 that is inserted into the spreading ring 3 without however pivoting the hooks 33 outwardly, and
- the spreading ring 3 that surrounds the bushing 2 and that, in turn, is surrounded by
- the outer part 4 without pressure already being exerted at the inner side onto the nose 43.

Upon insertion of the stopper with rotary cover for the purpose of closing off (locking) the container 100, the stopper first moves easily into the fill opening 101 and only upon producing the engagements between spreading ring 3, bushing 2, and outer part 4 an increased force expenditure is required. The stopper comprises moreover the plug 6 which will be described below.

In the afore described arrangement, the outer part 4 is thus the longest component that completely accommodates the bushing 2 and the spreading ring 3.

The rotary cover 5 is comprised of a cover plate 54 from which, displaced in radial direction inwardly, a sleeve 51 is extending in downward direction. Suitably, the outer circumference of the bushing 2 is matched to the spreading ring 3 and therefore so large that the bushing 2 displaces the hooks 33 that are still initially pointing inwardly and pivots them outwardly; in doing so, the bushing 2 moves downwardly so the groove 22 of the bushing 2 engages the inner bottom edge of the now outwardly rotated hooks 33. The outwardly rotated hooks 33 press against the inner wall of the sleeve 42 of the outer part 4 in the area of the nose 43 and displace the plastic material, preferably rubber that is chemically inert and food-compatible relative to the beverage and is as soft as possible, and push thus the nose 43 onto and about the rim 102 of the fill opening 101. Accordingly, the rim 102, having a thickness of about 0.6 mm in standard kegs, of the container or beer keg 100 which is usually made of sheet metal and is at risk of corrosion upon contact with the beverage, is seal-tightly engaged by the nose 43 and is thus protected from corrosion.

Figure 5:
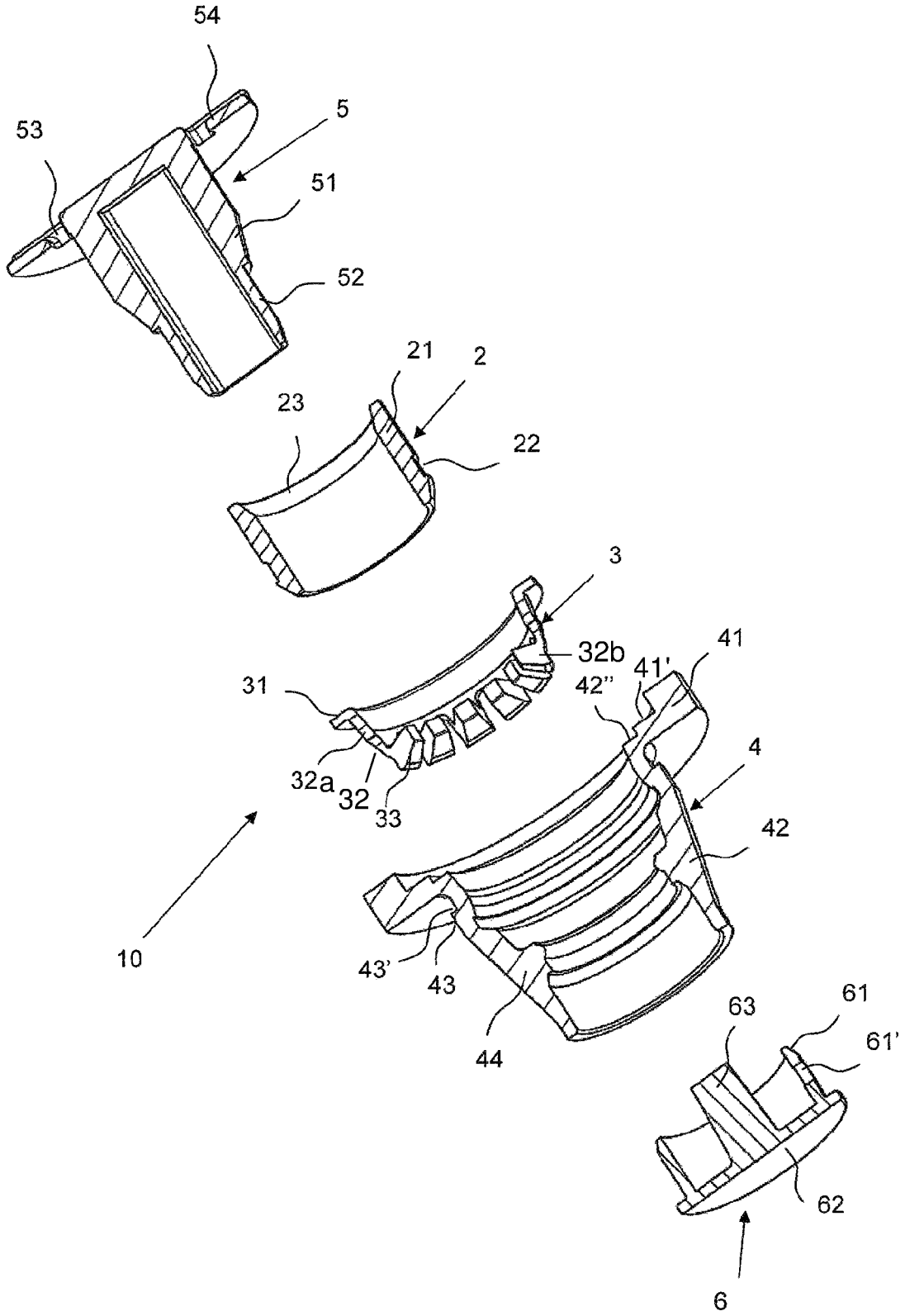
FIG. 5 a perspective exploded side view in section of a stopper according to the invention.
Figure 6:
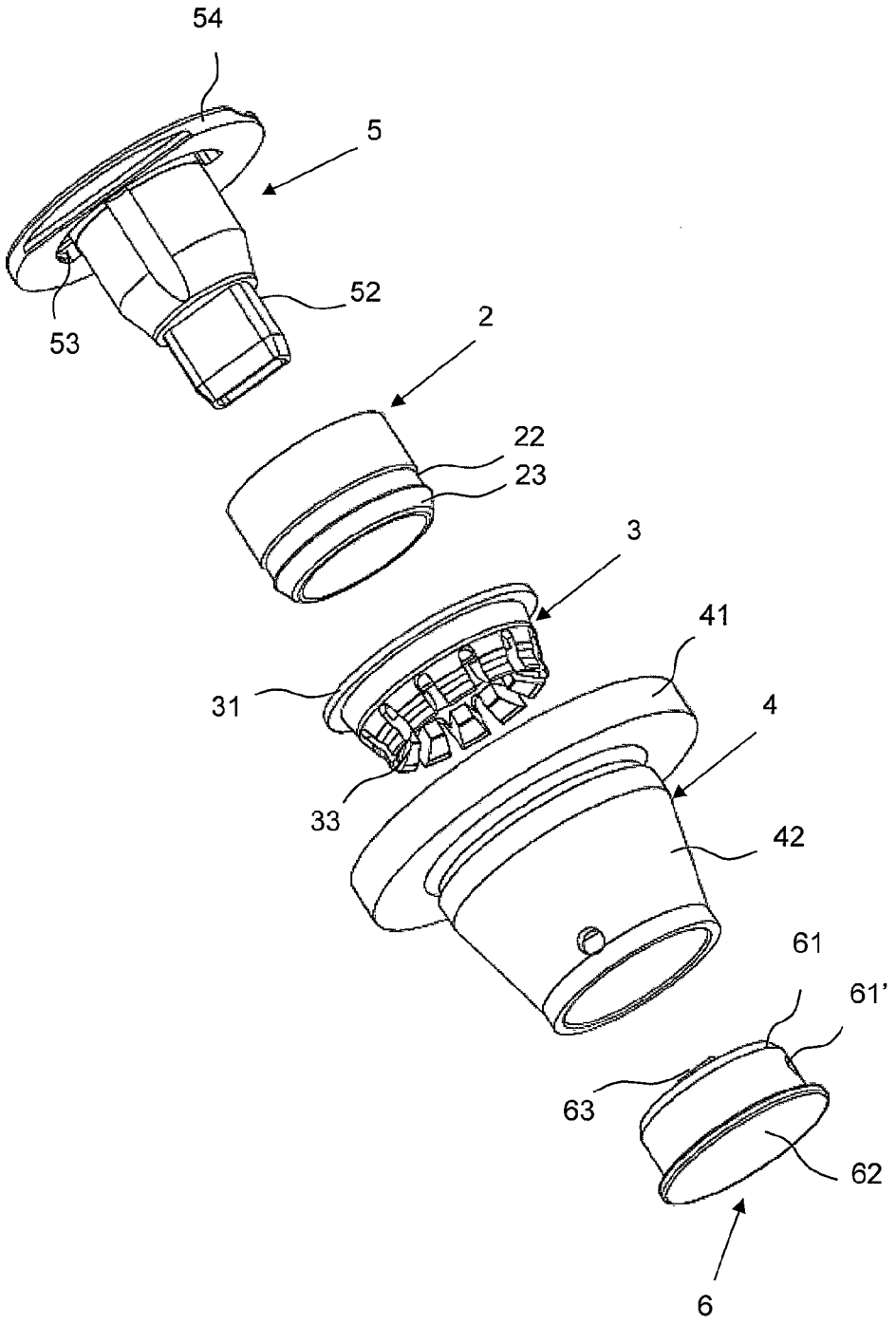
FIG. 6 a perspective exploded view of a stopper according to the invention.

When the rotary cover 5 has been inserted completely, its cover plate 54, as can be seen in FIG. 4, is resting with its rim on the contact surface 41' of the outer part 4. The rotary cover has here on its sleeve 51 a step (not principally required, another embodiment is possible also) which is matched to the shape of the plug 6. The plug 6, as shown in FIGS. 4, 5 and 6, can be comprised in a suitable way of the illustrated cover plate 62 from which the central presently solid core 63 is extending away and which is surrounded by a sleeve 61 that is spaced apart by a gap. Core 63, sleeve 61, and gap are designed such that the plug 6 from below, i.e., arranged facing the keg, can be pushed onto the stopper 1 and close it off with form fit and therefore seal-tightly. In this context, the plug 6 is preferably seated such that when the container is not to be vented, the bore 61' in the sleeve 61 is displaced from the bore that is provided in the outer part 4, the displacement can be 90° but can also be selected to be different, depending on the arrangement and number of the respective bores. The core 63 comes to rest with its exterior wall form-fittingly with play on the inner wall of the sleeve 51 of the rotary cover 5 so that the plug can be rotated.

The core 63 of the plug 6, as instantly shown in an exemplary fashion, can have a cross-section that deviates from a circular shape, for example, elliptical, flattened elliptical, or dihedral-type cross-section, and that is matched to the shape of the inner cross-section of the rotary cover 5 at its lower section 52 so that the rotary cover 5 when pushed in produces form fit with the core 63.

In principle, also other geometries are possible than the aforementioned elliptical, flattened elliptical or dihedral cross-sectional shape as long as they allow for the rotary cover 5 to be pushed in to the required depth in which the spreading ring 3 pushes the nose 43 in the desired way seal-tightly into contact against the rim 102 of the beer keg 100.

Figure 8:
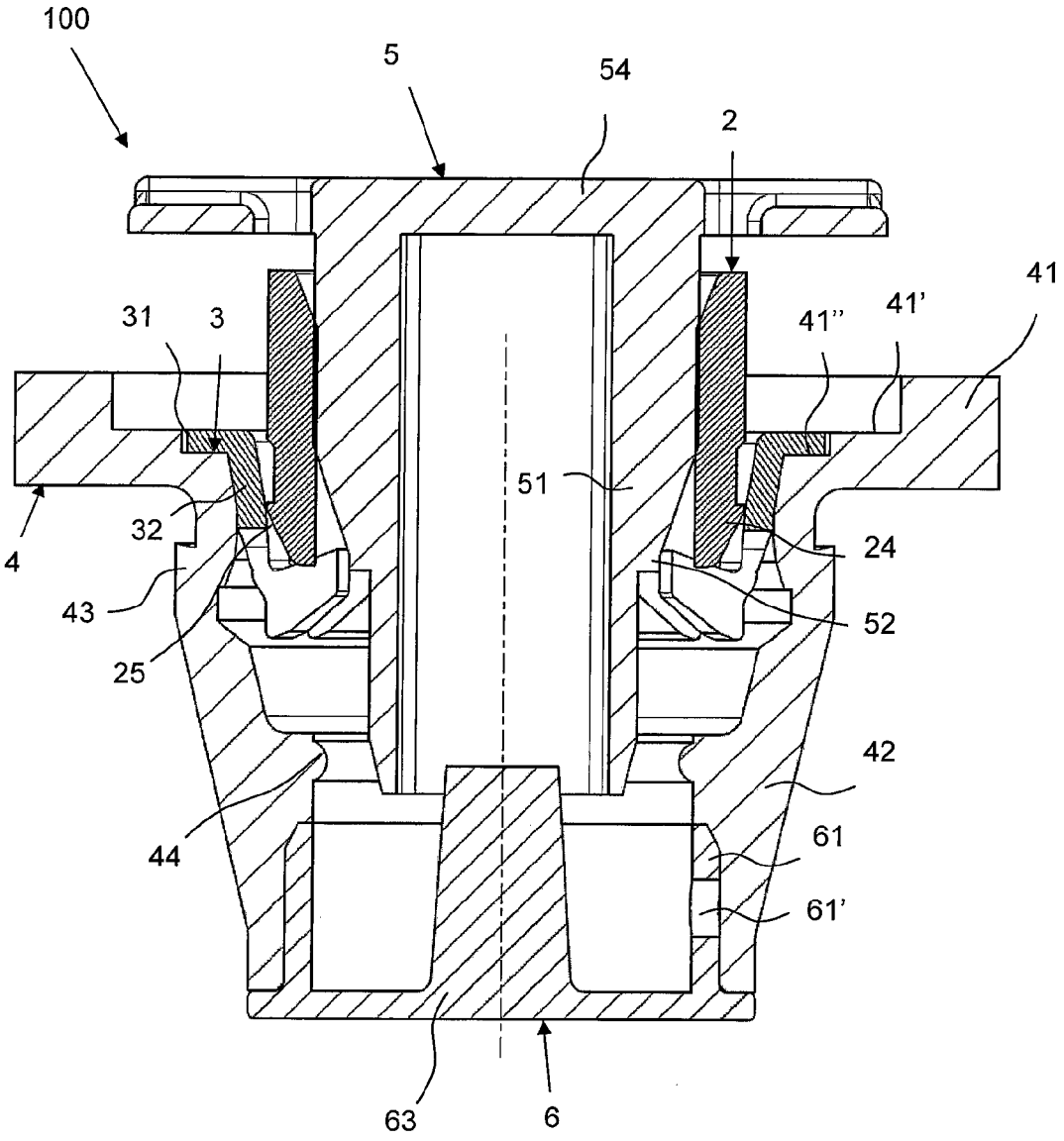
FIG. 8 a further side view in section of the stopper according to the invention with pre-positioned rotary cover.

FIG. 8 shows the arrangement of the components that form the stopper 1, incidentally in an "arrangement of non-use" or "pre-positioning arrangement". Here, the rotary cover is not yet pushed in but pre-positioned in the bushing 2 such that it is prepared therefor. It is just resting on the core 63 of the plug 6 which is inserted from below into the outer part 4. The bushing 2 projects already to some extent into the spreading ring but does not yet cause the hooks 33 to rotate outwardly; they are still pointing radially inwardly. By the way, these hooks 33 can also be shaped differently inasmuch that they still fulfill the described function. The spreading ring 3 is thus also pre-positioned in the outer part 4. The annular flange 31 of the spreading ring 3 is positioned on the lower step 41" of the annular flange 41 and is held by it.

Rotation of the rotary cover 5 for venting can be realized, for example, by means of a grip which is here provided so as to be pivotable and insertable into the groove 53 in the cover plane. Instead of the grip, other possibilities may be provided that are known to a person of skill in the art so that the user can grip and turn the rotary cover 5. For example, a differently shaped groove could be provided which can be engaged by a coin for rotation.

After arranging the stopper 1 in the fill opening 101 of the keg, the rotary cover 5 can again be pulled out of the stopper arrangement without its seal function being impaired which is exerted by the nose 43 onto the rim 102 of the beverage container 100. When the rotary cover 5 is removed, a draw tube 110 as part of a tapping assembly or of a tab (not illustrated) can be inserted, see, for example, FIG. 2, into the remaining cylindrical opening that is formed by the bushing 2.

On the other hand, FIG. 4 represents incidentally a "closure arrangement" of the stopper 1 in which the beer keg 100 or another beverage container is securely closed off; FIGS. 3 and 2 show "tapping assemblies" in which the stopper 1 in a seal-tight way is illustrated in the fill opening 101 of the beer keg 100 without rotary cover 5 and instead with inserted draw tube 110.

In this context, it should be mentioned that the stopper 1 must not necessarily be designed such that it can receive a draw tube 110. Since the known party kegs optionally also can be provided with a standard tap, that is inserted at the circumference of the keg, the stopper 1 in this case can be provided to only close off the fill opening 101. In this case, the stopper 1 can serve for venting when the rotary cover 5 positions the plug 6 upon rotation in such a way that its bores 61 are aligned with the bores of the outer part 4 (bores not illustrated).

When the stopper 1 is part of the tapping assembly, as can be seen also in FIG. 2, the outer part 4 can comprise an inner circumferential bead 44 (not mandatorily required for all embodiments of the invention) whose inner circumference corresponds with the outer circumference of the draw tube 110 just about such that the latter is surrounded seal-tightly.

When the draw tube 110 is inserted into the stopper 1, the plug 6 which is also manufactured of food-compatible material and is chemically inert relative to the beverage, is pushed into the interior of the container 100.

When the rotary cover 5 has been removed, the stopper 1 therefore forms the tapping device together with the draw tube 110 and the appropriate handling device for conveying the beverage.

What is claimed is:

1. A stopper for a beverage container, the stopper comprising:

an outer part comprising a first annular flange and further comprising a sleeve connected to an underside of the first annular flange, wherein the sleeve, below the first annular flange, is deformed circumferentially to a bulge;

a spreading ring comprising a second annular flange and further comprising L-shaped elements each comprising a first leg and a second leg connected to each other at a pivot point, wherein the first leg is connected with an end opposite the pivot point to an underside of the second annular flange and extends in an axial direction of the spreading ring downwardly away from the underside of the second annular flange, wherein, in a radial rest position of the second leg, the second leg extends lengthwise from the pivot point inwardly in a radial direction of the spreading ring and comprises a free end opposite the pivot point pointing radially inwardly, wherein the second leg, in said radial rest position, has a first face facing in the axial direction upwardly toward the underside of the spreading ring and a second face opposite the first face and facing in the axial direction downwardly away from the underside of the spreading ring, wherein the second leg comprises a hook arranged on the second face and pointing in the axial direction downwardly away from the second face, wherein the hook, in said radial rest position, is pointing in the axial direction downwardly away from the underside of the second annular flange, wherein the L-shaped elements are spaced apart from each other in a circumferential direction of the second annular flange;

a bushing;

a rotary cover comprising a cover plate and further comprising a sleeve that is connected to an underside of the cover plate and is displaced radially inwardly relative to an outer circumference of the cover plate and extends in downward direction away from the underside of the cover plate;

wherein, in an arrangement of non-use of the stopper, the spreading ring is pre-positioned in the outer part, the bushing projects partially into the spreading ring, the rotary cover is pre-positioned in the bushing, and the second legs of the L-shaped elements are in said radial rest position;

wherein, in a closure arrangement of the stopper, the rotary cover, the spreading ring, and the bushing are accommodated so far within the outer part that the second legs are rotated about the pivot point from said radial rest position into an axial position, wherein in the axial position the free ends of the second legs point in the axial direction downwardly away from the underside of the spreading ring, the second faces are facing in the radial direction outwardly, and the hooks point radially outwardly and engage the bulge of the sleeve of the outer part and force a circumferential projection formed by the bulge in a direction toward the underside of the first annular flange.

2. The stopper according to claim 1, wherein the outer part is comprised of a plastic material.

3. The stopper according to claim 2, wherein the plastic material is rubber.

4. The stopper according to claim 2, wherein the plastic material is a thermoplastic elastomer.

5. The stopper according to claim 1, wherein the sleeve of the outer part comprises an outer circumference and the outer circumference tapers conically in a direction away from the first annular flange.

6. The stopper according to claim 1, wherein the stopper further comprises a plug that comprises a cover plate and a core centrally connected to a top side of the cover plate and extending away from the cover plate, wherein the plug further comprises a sleeve that surrounds the core so that a gap is formed between the core and the sleeve of the plug.

7. The stopper according to claim 6, wherein the sleeve of the plug comprises at least one bore and the sleeve of the outer part comprises at least one bore, wherein the plug is configured to align the at least one bore of the plug with the at least one bore of the sleeve of the outer part.

8. The stopper according to claim 6, wherein the core, the sleeve of the plug, and the gap are arranged relative to each other such that the plug is configured to be attached with form fit and seal-tightly to an end of the outer part that is facing away from the first annular flange.

9. The stopper according to claim 8, wherein the core is resting with form fit in the sleeve of the rotary cover.

10. The stopper according to claim 9, wherein a cross-sectional shape of the core and an inner cross-sectional shape of the sleeve of the rotary cover are configured such that the core and the sleeve of the rotary cover are in rotary engagement with each other.

11. The stopper according to claim 10, wherein the cross-sectional shape of the core and the inner cross-sectional shape of the sleeve of the rotary cover are elliptical or flattened elliptical.

12. The stopper according to claim 1, wherein the bushing is longer than the spreading ring and comprises a groove on an outer circumference of the bushing, wherein the groove, in the closure arrangement of the stopper, engages an inner bottom edge of the hooks.

13. The stopper according to claim 1, wherein the rotary cover, after the closure arrangement has been established, is removable from the stopper while the arrangement of the spreading ring in the stopper is maintained.

14. The stopper according to claim 13, wherein the bushing, after the rotary cover has been removed, defines a cylindrical opening configured to receive a draw tube of a tapping device.

15. A tapping assembly comprising a stopper according to claim 1 and a tapping device comprising a draw tube, wherein the draw tube extends through the stopper.

16. The tapping assembly according to claim 15, wherein the outer part of the stopper comprises an inner circumferential bead and wherein the draw tube arranged in the stopper is fluid-tightly surrounded by the inner circumferential bead of the outer part in an axial direction of the stopper.

17. A beverage container comprising a fill opening with a rim and a stopper according to claim 1 inserted into the fill opening and closing off the fill opening, wherein the rim is fluid-tightly surrounded by a circumferential projection formed by the bulge of the outer part of the stopper, the circumferential projection forced in the direction toward the underside of the first annular flange of the outer part.

* * * * *